US006169481B1

(12) United States Patent
Goldberg et al.

(10) Patent No.: US 6,169,481 B1
(45) Date of Patent: Jan. 2, 2001

(54) LOW COST MATERIAL SUITABLE FOR REMOTE SENSING

(75) Inventors: Ira B. Goldberg; Charles S. Hollingsworth, both of Thousand Oaks, CA (US); Elik I. Fooks, Lexington, MA (US); Mark A. Lucak, Hudson; Jonathan D. Bradford, Harpersfield, both of OH (US)

(73) Assignee: Rockwell Technologies, LLC, Thousand Oaks, CA (US)

( * ) Notice: Under 35 U.S.C. 154(b), the term of this patent shall be extended for 0 days.

(21) Appl. No.: 09/290,454

(22) Filed: Apr. 12, 1999

(51) Int. Cl.[7] ..... G08B 13/14

(52) U.S. Cl. ..... 340/572.1; 340/551; 340/676; 156/64; 324/207.24

(58) Field of Search ..... 340/551, 552, 340/571, 572, 1, 572.2, 572.4, 572.6, 676, 825.34, 825.35, 825.54; 235/383, 385, 380; 156/64, 362, 363; 324/207.24, 207.26, 228, 236

(56) References Cited

U.S. PATENT DOCUMENTS 3,849,633 * 11/1974 Reiboeck et al. ..... 340/676
4,623,877 * 11/1986 Buckens ..... 340/572.2
4,823,113 * 4/1989 Hasegawa ..... 340/551
4,857,891 * 8/1989 Heltemes ..... 340/551
4,866,383 * 9/1989 Taliaferro ..... 324/207.24
4,967,184 * 10/1990 Regelsberger ..... 340/572.6
5,029,291 * 7/1991 Zhou et al. ..... 340/551
5,174,851 * 12/1992 Zodrow et al. ..... 156/357
5,664,582 * 9/1997 Szymaitis ..... 128/898
5,785,913 * 7/1998 Clark et al. ..... 264/109
5,873,966 * 2/1999 Goldberg et al. ..... 156/64
5,973,606 * 10/1999 Maitin et al. ..... 340/676

* cited by examiner

*Primary Examiner*—Van T. Trieu
(74) *Attorney, Agent, or Firm*—Keith M. Baxter; John J. Horn; William R. Walbrun

(57) ABSTRACT

High aspect ratio filaments of magnetic material are randomly dispersed in a non-magnetic matrix such as paper or plastic for part of a critical component of a manufactured product to permit remote sensing of the manufactured product by the application of an external oscillating magnetic field and the detection of the resulting induced magnetization. The material may be incorporated into a wide variety of products that must be remotely sensed.

18 Claims, 2 Drawing Sheets

LOW COST MATERIAL SUITABLE FOR REMOTE SENSING

BACKGROUND OF THE INVENTION

The present invention relates to systems and materials for presence sensing, and in particular, to a low cost material with magnetizable filaments whose presence may be sensed remotely by an industrial control system.

In the manufacture of a multi-component product, for example, packaged pharmaceuticals intended for over-the-counter sale, it is important to verify that the package includes a paper insert listing the characteristics of the drug and instructions for safe use. While considerable care is taken in placing the insert into the package, ideally, its presence in the package could be verified after the package is sealed. One way of doing this is by weighing the package to detect the additional weight of the insert. For light inserts or products that vary in weight, such an approach is unreliable.

What is needed is a low cost method of sensing the presence of an insert or similar component of a product, after the product is sealed in a package.

BRIEF SUMMARY OF THE INVENTION

The present invention provides a material incorporating a small percentage of filamentized magnetic material whose presence may be detectable at a distance. The material is versatile and of low cost and may be used for a wide variety of presence sensing applications including detection of critical product components in manufacture multi-component products such as packages as described above.

Specifically the material is formed of a non-magnetic matrix material in which is dispersed a plurality of magnetizable filaments. The filaments may represent a relatively low volume percentage of the matrix (for example, 0.1%) and the matrix material may be selected from a wide variety of non-magnetic materials including paper and plastic.

Thus it is one object of the invention to provide a method of remote sensing in which the material to be sensed is modified and an external tag is not needed. The low percentage of fibers and low cost of the fibers allow them to be directly incorporated into a variety of raw materials.

The filaments preferably have an aspect ratio that is quite large and, for example, may have a length of 3–6 mm and a diameter of 2–16 microns.

Thus it is another object of the invention to minimize the demagnetization effect, a bulk property of magnetic materials that resists their magnetization. The high aspect ratio allows the filaments to be easily magnetized by an external magnetic field, increasing the distance at which their presence may be sensed. This is in contrast to magnetic inks using granular magnetic materials which can only be detected at short range.

The filaments may be formed of a magnetically "soft" material with high permeability.

Thus it is another object of the invention to permit remote sensing of the filaments by detection of a distortion of magnetization field caused by magnetization of the filaments and/or their saturation. Measurement of distortion of an applied oscillating magnetic field provides an extremely sensitive detection technique.

A detection system for the material may include an oscillator producing a waveform at a fundamental frequency and any antenna structure connected to the oscillator for transmitting the waveform as a magnetic field to envelop the sensed material. An electronic detector connected to the antenna structure may detect a distortion in the waveform caused by the magnetization or saturation of the filaments in the applied field.

Thus it is another object of the invention to provide a sensing scheme that may work at considerable distance from the filaments, and that is indifferent to absolute magnetic signal strength which may vary depending on the distance between the sensed material and the antenna structure and the orientation of the sensed material. Because of their high permeability, the signal from the filaments is uniquely different from signals that could arise from other materials of lower permeability material such as from a conveyor belt or other incidental metal. Due to different frequencies being used, the signal is also different from power line fields and the like.

The antenna structure may be a Helmholtz coil pair positioned about the sensing target.

Thus it is another object of the invention to provide a simple antenna structure that transmits and receives electromagnetic signals uniformly over a volume. Sensitivity of the detector to variation in the location of the sensed object with respect to the antenna is thus reduced.

The detector may analyze the harmonic distortion of the waveform and may be phase sensitive to detect only distortion in phase with the driving waveform.

Thus it is another object of the invention to employ detection techniques that provide improved signal-to-noise ratio in the detected signal so to provide increased distance between the sensed material and the antenna structure of the detector.

The foregoing and other objects and advantages of the invention will appear from the following description. In the description, reference is made to the accompanying drawings which form a part hereof and in which there is shown by way of illustration a preferred embodiment of the invention. Such embodiment does not necessary represent the full scope of the invention, however, and reference must be made to the claims herein for interpreting the scope of the invention.

DETAILED DESCRIPTION OF THE INVENTION

Figure 1:
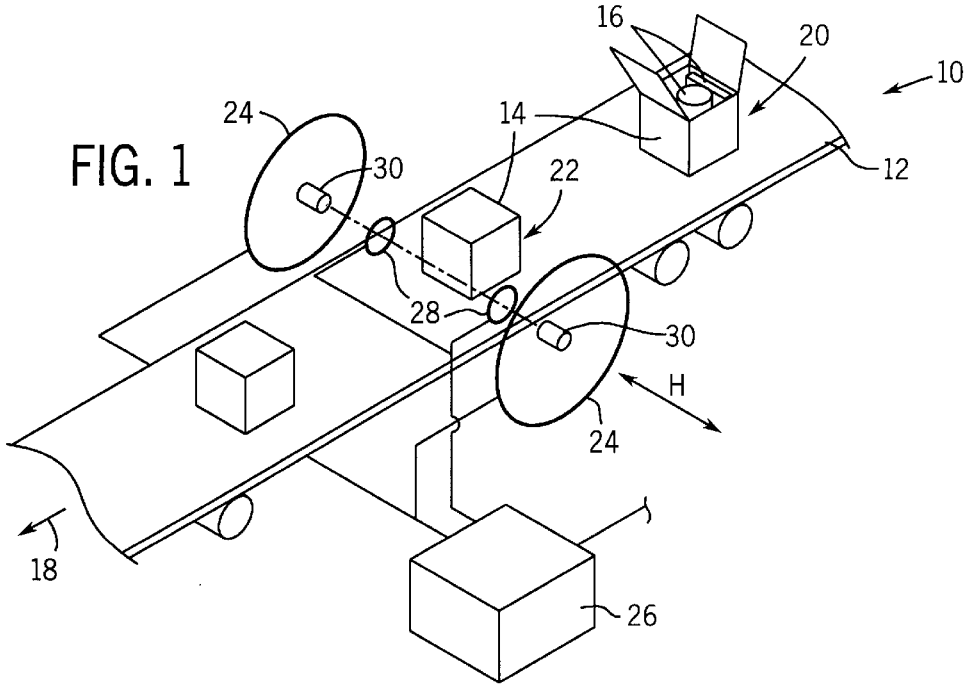
FIG. 1 is a perspective view of an assembly line in which a product including material of the present invention is enclosed in a package and later remotely, sensed by a sensing device of the present invention.

Referring now to FIG. 1, an assembly line 10 may include a conveyor belt 12 transporting boxes 14 along a direction 18. At a first station 20, the box 14 may be opened and a product 16 is installed therein. With further motion of the conveyor belt 12 in direction 18, the box 14 is brought to a second station (not shown) where the box is closed and sealed.

At a third station 22, the box and the product 16 contained therein pass between coils 24 coaxially opposed across the conveyor belt 12 perpendicular to the direction 18. As will be described below, the coils are connected together as a Helmholtz coil pair for the generation and detection of electromagnetic signals in the volume between the coils 24. Other well known types of sensing and excitation coils may be used. A pair of sensing coils 28 may also be positioned coaxial with the coils 24, but closer to the path of the box 14 on the conveyor belt 12. Conventional proximity sensing elements 30 such as photoelectric sensors may also be positioned along the conveyor belt 12 to detect the presence of the box 14 in third station 22 so as to activate the sensing of the box's contents, as will be described below.

Figure 2:
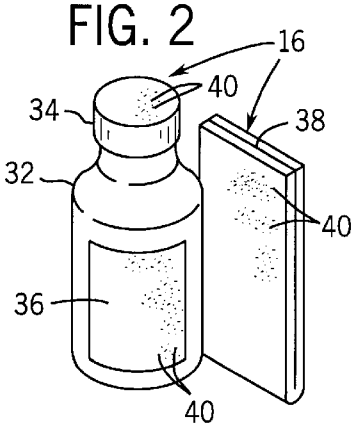
FIG. 2 is a perspective view of example uses of material of the present invention including a package cap, label, and instructional insert.

Referring now also to FIG. 2, the product 16 within the box 14 may include, for example, a bottle 32 containing a pharmaceutical material. The bottle may have a resealable cap 34, a label 36 affixed to the bottle's surface, and may be packaged with a paper insert 38 providing information about the pharmaceutical material.

At different stages of the product's manufacture, it may be desirable to determine the presence of any one of the cap 34, label 36 and paper insert 38 Accordingly, any one of the materials of these elements may be treated by the incorporation of a plurality of magnetic filaments 40 into the material of the element. In the case of a cap 34, the filaments may be mixed with the thermoplastic from which the cap is molded in the manner of fiberglass and other reinforcement materials according to techniques well known in the art in which the fibers are dispersed in the liquefied plastic.

For the label 36, which for the purpose of example, may be printed directly on the bottle 32, the filaments 40 may be mixed with the printing inks. It will be understood that alternatively, the filaments could be in the label paper or adhesive. The paper insert 38 may have filaments 40 that were introduced during the papermaking process to blend and disperse with the cellulose fibers of the paper pulp. The paper may then be processed and printed by conventional means.

Figure 3:
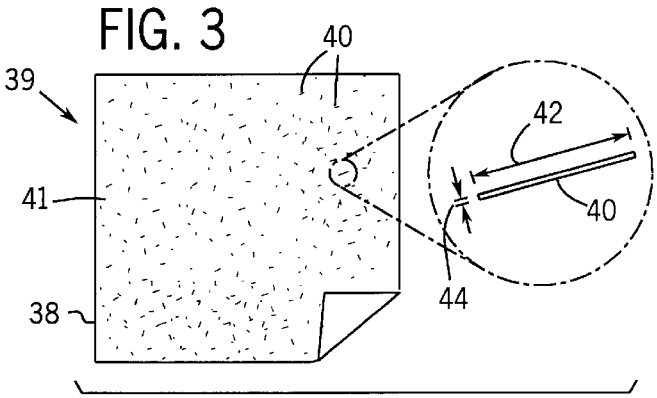
FIG. 3 is a plan view and enlarged detail showing the instructional insert of FIG. 2 having magnetic filaments dispersed within a paper matrix.

Referring now to FIG. 3, in the present example of FIG. 1, it may be desired to confirm that the paper insert 38 is within the box 14 after the box has been sealed. Accordingly, in this case, only the paper insert 38 includes the filaments 40. The filaments 40 are randomly dispersed within the paper constrained only by the thickness of the paper (causing the filaments to lie within the plane of the paper) and a degree of alignment caused by papermaking process which align the fibers of the paper in a "grain" generally determined by the water flow over the Fourdrinier screens. In the present example, however, within the plane of the paper, it is desired that the filaments 40 obtain the greatest random dispersion both in location and orientation to ensure a signal regardless of orientation of the paper insert 38 after it has been folded and placed in the box 14.

Each of the filaments 40 in the preferred embodiment is constructed of an easily magnetizable material or "soft" material of coercivity of less than 4 oersteds and preferably less than 2 oersteds. Coercivity is the magnetic field that must be applied opposite to the magnetization direction of a magnetically saturated material that is required to reduce the magnetization to zero. Suitable materials include permalloy, supermalloy, and metglas, however other similar materials may be used. The more easily the material is magnetized, the greater the signal that may be produced by the filaments 40 and the further away the filaments 40 may be detected as will be described. The material of the filaments 40 may preferably have a permeability greater than 200 gauss per oersted again to allow them to be more readily detected. A limit on the permeability or the number of filaments, however, may be established so that the filaments 40 do not trigger anti-shoplifting devices which may use a similar principle of detecting saturation of larger foils of magnetic materials within a magnetic field.

Desirably the filaments 40 have a very high aspect ratio, the aspect ratio being a ratio between the fiber's length 42 and diameter 44 (shown much exaggerated in FIG. 3). In the preferred embodiment, a length of 3 mm in diameter of 8 microns has been found to be achievable, however, generally aspect ratios of greater than 3 will realize some improvement in signal strength and aspect ratios of greater than 1,000 may be desired. The high aspect ratio decreases demagnetization effects in which the material of the fibers 40 fight the external magnetic field applied to the fibers 40. Thus generally higher aspect ratios are preferred.

The size of the fibers 40 in length and diameter may be adjusted so as to improve their miscibility with the matrix material 41 of paper, plastic or paint. Generally in these cases, it is desired that the fibers 40 remain suspended and not settle from the matrix during the processing. The optimum size of the fibers 40 may be determined empirically. The small size in diameter of the filaments 40 render them invisible or nearly invisible when incorporated into paper or other materials. Filaments 40 may be clad with a noncorrosive material so as to prevent rusting in place in the matrix.

The matrix material 41 may be selected from a variety of non-magnetic low permeability materials. Together the fibers 40 as dispersed in the matrix material 41 produce a target material 39 whose presence may be remotely sensed.

Figure 4:
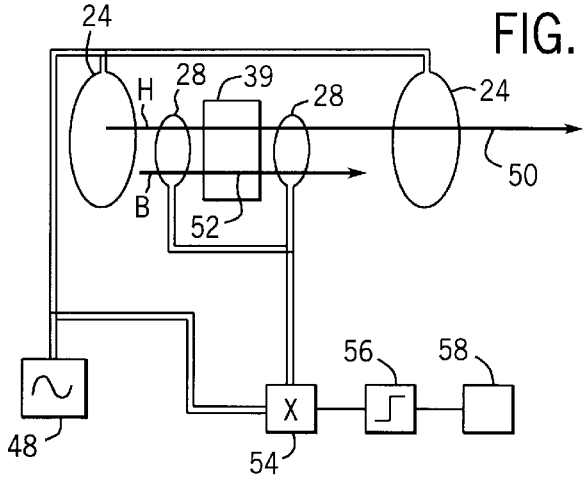
FIG. 4 is a schematic diagram of the sensing device of FIG. 1 employing synchronous detection of magnetization of the filaments.

Referring to FIG. 4, detection of the target material 39 may be performed in a number of different manners. In a first system, the Helmholtz coils 24 are connected to electrical amplifier/oscillator 48 driving the coils with a sine wave signal preferably having a value between 0.5 kHz and 2000 kHz so as to make use of high powered audio frequency amplifier components. It will be understood that the exact frequency may be chosen for convenience. High frequencies increase the sensitivity of the pick-up coil and decrease the interference from 60 cycle harmonics from power lines and the like. The amplifier/oscillator 48, so connected, creates an oscillating external magnetic field 50 (H) aligned with the axis of the coils 24. The target material 39 when stimulated by the H field 50 causes a magnetic induction field 52 (B), being the result of a magnetization M of the filaments 40 (and in particular those filiments aligned with the H field 50).

The B field 52 may be received by sensing coil 28 and detected by means of phase detector 54 whose output may be provided to a magnitude or threshold detector 56 to produce a signal at I/O block 58 such as may be connected to an industrial control system or the like to provide an output signal and effect a predetermined control action. The phase detector 54 detects the B field 52 only so far as it is at the proper phase with the H field 50 so as to reduce the effects of environmental noise on the detection process. It will be understood that the coils 28 may be another form of magnetization detection such as a Hall effect device or the like.

Figure 5:
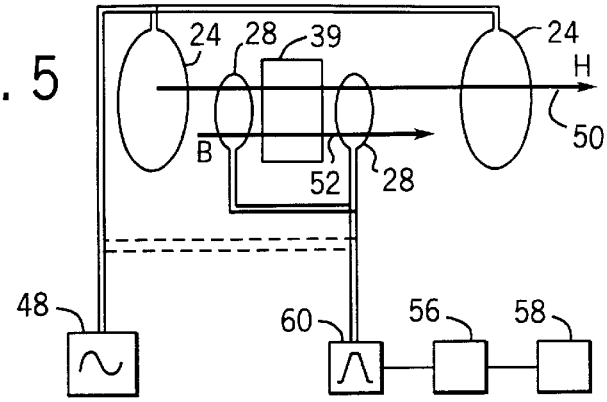
FIG. 5 is a figure similar to that of FIG. 4 showing an alternative embodiment of the sensing device employing frequency domain analysis of the total magnetization to detect saturation of the filaments of FIG. 3.

Referring now to FIG. 5, in an alternative embodiment of the detection system, the coils 24 are again attached to amplifier/oscillator 48 in parallel so as to generate an oscillating H field 50 along their axis. The sensing coil 28 may be used to detect the B field 52 from the target material 39 or alternatively the coils 24 may serve double duty both as transmitting and receiving antennas. In either case, a B field signal may be provided to a band pass filter 60 having a pass band admitting only a frequency significantly above the fundamental frequency $f_0$ of the amplifier/oscillator 48. In this way, distortion of the waveform may be detected such as results in the introduction of higher ordered harmonics to a sine wave. It will be recognized that other waveform distortion detection systems may be used.

Figure 8:
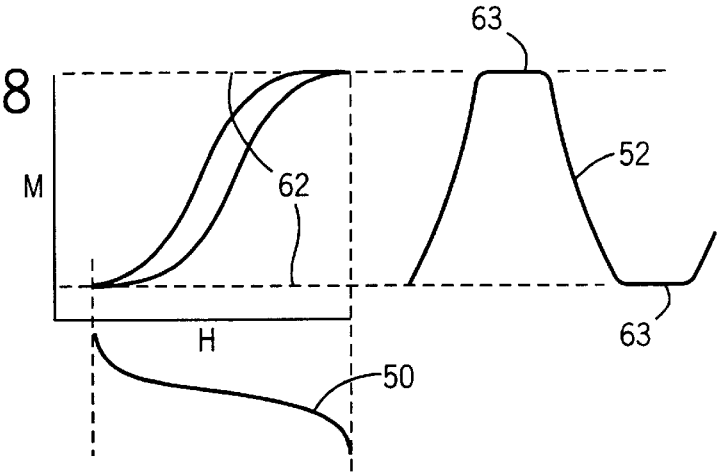
FIG. 8 is a plot of magnetic induction B vs. external magnetic field H showing saturation of the magnetic filaments of the material of the present invention.

Referring now to FIG. 8, the distortion of the B field 52 with respect to the H-field waveform results from phenomenon of magnetic saturation of the filaments 40. The filaments 40 under the presence of the external field H 50 and as a function of their permeability and softness, will become magnetized in conformity with the H field 50 producing a greater magnetization M with increasing field H up to saturation limits 62 whereafter no further increase in magnitude of the magnetization may be had because all magnetic domains are aligned. At this point the M field is truncated as indicated by plateaus 63 with the effect that the field 52 experiences a distortion introducing the higher ordered harmonics that are detected.

Figure 6:
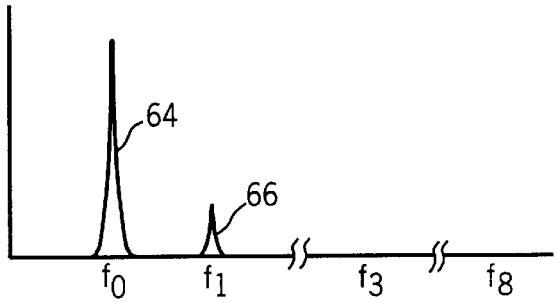
FIG. 6 is a spectrum diagram of the output of the sensing device of FIG. 5 in the absence of material of the present invention.

Referring to FIG. 6, if the H field is essentially a pure sine wave, in the absence of any saturated material, the detected B field 50 will exhibit a fundamental frequency 64 at the frequency of the sine wave and possibly a first harmonic or lower order harmonic 66 resulting from imperfections in the sine wave generation but essentially no harmonic content above the third harmonic.

Figure 7:
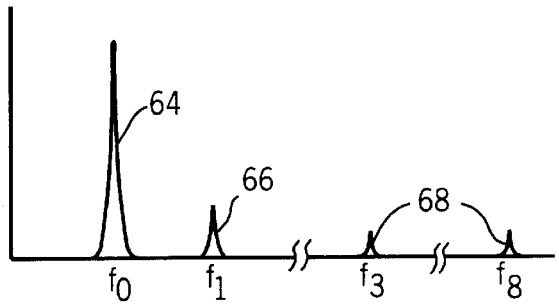
FIG. 7 is a figure similar to that of FIG. 6 showing output of the sensing device of FIG. 5 in the presence of material of the present invention.

Referring to FIG. 7, with the introduction of the target material 39 however and its saturation, harmonic components 68 will be introduced starting at the third harmonic and extending to the fortieth and beyond harmonic as shown in FIG. 7 in amount depending on the strength of the M component and the sharpness of the saturation plateaus 63. These harmonic components, isolated through the band pass filter 60 of FIG. 5 are provided to the threshold detector 56 to provide the output to an industrial control system 58 or other output device as has been described. The control system may provide an output indicating proper assembly of a multi-component product having a critical component incorporating the target material 39.

In an alternative embodiment not shown, the axis between the coils 24 may differ from the axis of the coil 28 so as to obtain off axis signal B-field 52. Techniques to reduce the detection of the external field H and to enhance the detection of the local field B may include a subtraction of the signal from the amplifier/oscillator 48 in phase with the detected signal or the use of sensing coils 28 wound in opposition so as to provide a cancellation effect for the H field 52 positioned asymmetrically with respect to he target material 39 so as not to cancel the detected magnetization, as is generally understood in the art.

The above description has been that of a preferred embodiment of the present invention. It will occur to those that practice the art that many modifications may be made without departing from the spirit and scope of the invention. For example, because the filaments respond primarily in one direction, three orthogonal coils could be used for detection and/or excitation of the filaments. The coils would be electrically isolated because of their orientation but could also be sequentially activated or distributed along a conveyor belt or the like so as to further minimize interference. In order to apprise the public of the various embodiments that may fall within the scope of the invention, the following claims are made.

We claim:

1. A method of verifying manufacturing operations in the assembly of multi-component products comprising the steps of:

(a) selecting one critical component of a multi-component product composed of a critical component necessary to the product and components other than the critical component;

(b) prior to assembly of the multi-component product attaching to the critical component and not to the other components a plurality of magnetizable filaments;

(c) assembling the critical component with the other components into the multi-component product, (d) exposing the assembled multi-component product to an oscillating electromagnetic waveform;

(e) detecting a distortion of the waveform unique to the magnetizable filaments of the critical component caused by saturation of the magnetizable filaments to detect the presence of the critical component; and (f) providing an output signal indicating proper assembly of the multi-component product with the critical component.

2. The method of claim 1 wherein the critical component is a paper instruction insert for a packaged pharmaceutical product and wherein the magnetizable filaments are incorporated into the paper of the instruction insert and wherein the other components include a sealed package into which the pharmaceutical product and the paper instruction insert are wholly contained.

3. The method of claim 1 wherein the filaments have an aspect ratio of length to thickness of greater than 3.

4. The method of claim 1 wherein the filaments have an aspect ratio of length to thickness of greater than 1000.

5. The method of claim 1 wherein the filaments are a soft magnetic material of a coercivity of less than 4 oersteds.

6. The method of claim 1 wherein the filaments are a soft magnetic material of a coercivity of less than 2 oersteds.

7. The method of claim 1 wherein the filaments have a length greater than 1 millimeter.

8. The method of claim 1 wherein the material of the filaments is selected from a group consisting of: permalloy, supermalloy and metglas.

9. The method of claim 1 wherein the critical component is paper and the magnetizable filaments are incorporated into the paper pulp at the time of paper manufacture.

10. The method of claim 1 wherein the critical component is a polymer and the magnetizable filaments are dispersed into the polymer during a liquid state.

11. The method of claim 1 wherein the critical component is painted and the magnetizable filaments are incorporated into the paint.

12. The method of claim 1 wherein the filaments are dispersed randomly within a portion of the critical component.

13. The method of claim 1 wherein the volume ratio of filaments to supporting material of the critical component is less than 1%.

14. The material of claim 1 wherein the volume ratio of filaments to supporting material of the critical component is less than 0.1%.

15. The method of claim 1 wherein the permeability of filaments is within the range of 200 to 2000 gauss per oersted.

16. The method of claim 1 wherein the critical component is a paper instruction sheet, further comprising the step of folding the paper instruction sheet for insertion into the package.

17. The method of claim 1 wherein the critical component is a container label, further comprising the step of attaching the label to a container and placing the container in the package.

18. The method of claim 1 wherein the critical component is a container lid, further comprising the step closing a container with the lid and inserting the closed container in the package.

* * * * *